United States Patent [19]

McCormick

[11] Patent Number: 4,530,667

[45] Date of Patent: Jul. 23, 1985

[54] MARINE DRIVE SHIFT LINKAGE

[75] Inventor: Daniel F. McCormick, Oshkosh, Wis.

[73] Assignee: Brunswick Corporation, Skokie, Ill.

[21] Appl. No.: 566,654

[22] Filed: Dec. 29, 1983

[51] Int. Cl.[3] ..... B63H 21/26

[52] U.S. Cl. ..... 440/75; 440/84; 440/86

[58] Field of Search ..... 440/75, 84, 86, 900; 74/378; 192/21, 48.91

[56] References Cited

U.S. PATENT DOCUMENTS

| | | | |
|---|---|---|---|
| 2,630,775 | 3/1953 | Kiekhaefer | 440/75 |
| 2,756,855 | 7/1956 | Kloss | 74/378 |
| 3,931,783 | 1/1976 | Croisant | 440/88 |
| 4,223,773 | 9/1980 | Croisant et al. | 192/48.91 |
| 4,258,642 | 3/1981 | Burmeister | 440/53 |
| 4,302,196 | 11/1981 | Blanchard | 440/75 |
| 4,323,356 | 4/1982 | Stephenson | 440/86 |
| 4,395,240 | 7/1983 | Blanchard | 440/86 |

FOREIGN PATENT DOCUMENTS

| | | | |
|---|---|---|---|
| 58-126289 | 7/1983 | Japan | 440/86 |

*Primary Examiner*—Trygve M. Blix
*Assistant Examiner*—Edwin L. Swinehart
*Attorney, Agent, or Firm*—Andrus, Sceales, Starke & Sawall

[57] ABSTRACT

Drive engaging linkage (2) for a marine drive lower gear case (4) includes linkage (38) for converting translational movement of an operator controlled stalk (32) into axial movement of an inner axial control shaft (20) within a propeller shaft (6) to in turn slide a clutch (18) axially along the outside of the propeller shaft into engagement with drive gear means (8). The stalk (32) and linkage (38) are part of a pre-assembled subassembly (66) inserted downwardly into the gear case. The linkage includes a crank (40) pivoted at a point (42) on the subassembly above the propeller shaft and axially spaced from the drive gears, and including a lever arm (46) loosely engaging a portion (48) of the inner control shaft extending axially beyond the drive gears.

14 Claims, 2 Drawing Figures 64
40
42
32
50
52
44
38
46
20
48
56
60
62
58

36

66
34
70
72
74
68
32
76
10
8
16
12
14
40
50
42
52
44
38
46
6
30
48
2
60
58
54
62
18
24
26
22
20
4
64
21
28

MARINE DRIVE SHIFT LINKAGE

DESCRIPTION

1. Technical Field

The invention relates to drive engaging linkage for a marine drive lower gear case.

2. Background

In Croisant et al. U.S. Pat. No. 4,223,773, an operator controlled stalk extends downwardly into a marine drive lower gear case and has a cam at its lower end for actuating a clutch between forward and reverse gears. The stalk is rotatable about a vertical axis for camming a clutch link or cam follower to axially move an inner control shaft within the propeller shaft, which in turn axially moves the clutch along the outside of the propeller shaft into engagement with drive gears.

In another known system, the operator controlled stalk moves up-down to pivot a bell crank which in turn moves an inner control shaft to actuate the clutch. The bell crank is mounted at a pivot point on the drive gear bearing housing, which housing is slid horizontally into the gear case during assembly. The stalk is then inserted downwardly, and is mated to the bell crank in threaded relation, for which further reference may be had to "OMC Marine Drive Systems", Outboard Marine Corp., Waukegan, Ill., 1981, pages 6–7, and additional reference to Blanchard U.S. Pat. Nos. 4,302,196 and 4,395,240, Stephenson U.S. Pat. No. 4,323,356, and Burmeister U.S. Pat. No. 4,258,642.

3. Disclosure of the Invention

Drive engaging linkage for a marine drive lower gear case is provided for converting translational movement of an operator controlled stalk through linkage means into axial movement of an inner control shaft to move a clutch along the outside of a propeller shaft. The stalk and the linkage, which may be a bell crank, are part of a pre-assembled subassembly inserted downwardly into the gear case and providing accurate three dimensional location of the linkage relative to the inner control shaft. Easier shifting at increased engine speeds is afforded, together with reduced cost.

BEST MODE FOR CARRYING OUT THE INVENTION

Figures 1, 2:
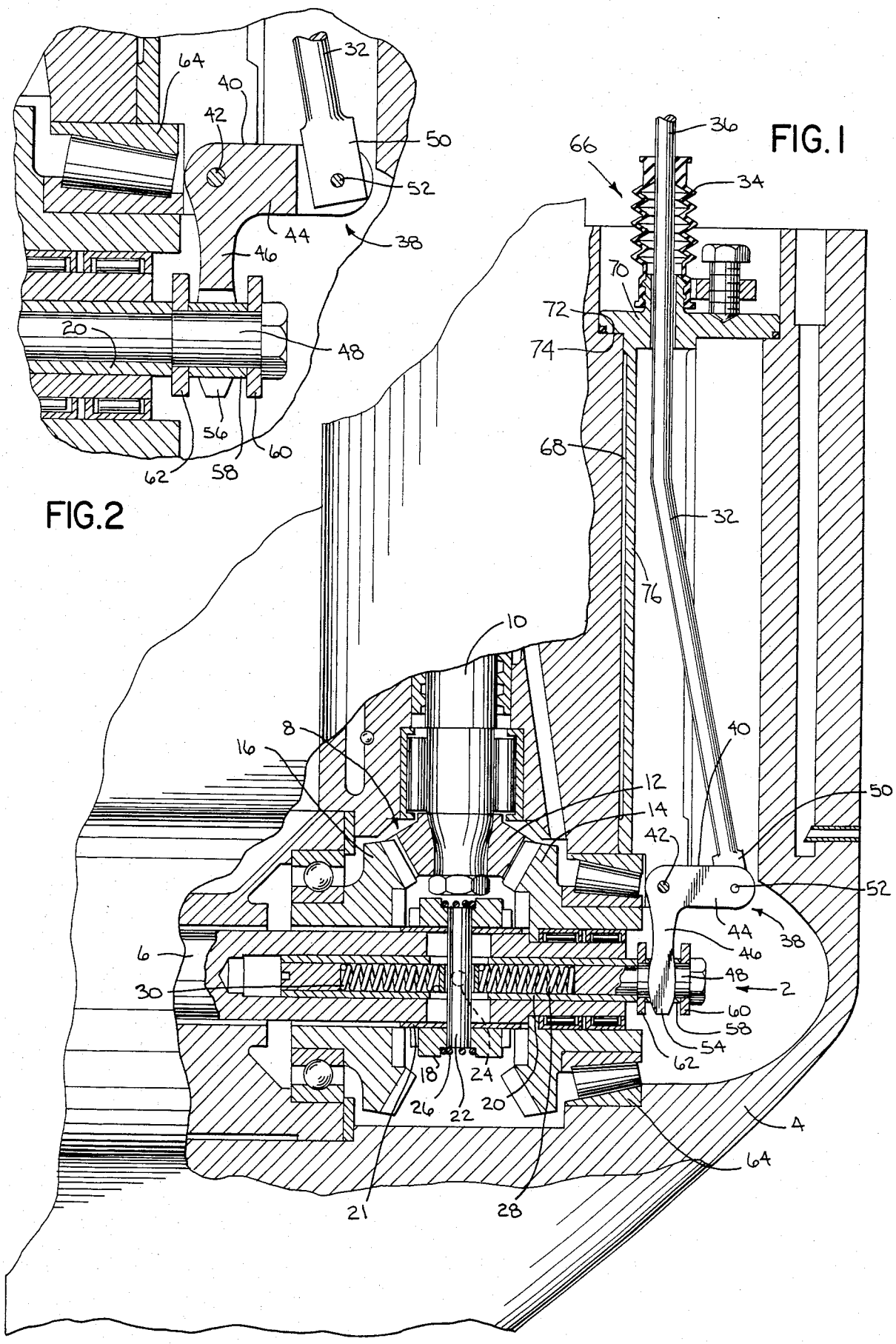
FIG. 1 is a partial sectional view of drive engaging linkage for a marine drive lower gear case constructed in accordance with the invention.
FIG. 2 is an enlarged isolated view of a portion of FIG. 1.

Drive engaging linkage 2 for a marine drive lower gear case 4 includes a propeller shaft 6 rotatably mounted in the gear case to produce axial thrust for marine propulsion, for which further reference may be had to Croisant et al. U.S. Pat. No. 4,223,773, incorporated herein by reference. Drive gear means 8 in the gear case drives propeller shaft 6. Vertical drive shaft 10 carries beveled drive gear 12 at its lower end which engages and drives gears 14 and 16 in oppositely rotating directions concentrically about propeller shaft 6. Clutch means 18 is axially slideable along the propeller shaft to engage either of driven gears 14 and 16 for driving the propeller shaft in right hand or left hand rotation for corresponding to forward or reverse directions, as in said Croisant et al. patent.

An inner axial control shaft 20 is axially slideable within propeller shaft 6 and is coupled to clutch 18 for axially moving the latter. Clutch 18 is nonrotatably secured to propeller shaft 6 and inner control shaft 20 by splines 21 and pin 22, as in said Croisant et al. patent. A neutral position is provided by detent 24 held by coil spring 26, as in said Croisant et al. patent. Resilient biasing springs 28 and 30 bear between pin 22 and respective stops in inner shaft 20 and overcome detent 24 to axially move clutch 18 in response to axial movement of inner shaft 20, as in said Croisant et al. patent.

Operator controlled stalk means 32 extends into lower gear case 4 and is translationally movable therein. Stalk 32 is vertically movable up-down through sealing bellows gasket 34 in response to operator movement of upper portion 36. Linkage means 38 is operatively connected between stalk 32 and inner axial control shaft 20 for converting the translational movement of stalk 32 into axial movement of inner control shaft 20 and clutch 18.

Linkage 38 includes a pivoted member 40 mounted in the gear case at pivot point 42, and having a first lever arm 44 operatively coupled to stalk 32, and a second lever arm 46 operatively coupled to inner control shaft 20. Up-down translational movement of stalk 32 moves first lever arm 44 which pivots member 40 about point 42 which moves second lever arm 46 which moves inner control shaft 20 axially which moves clutch 18 axially along the outside of propeller shaft 6. Second lever arm 46 directly engages inner control shaft 20 without an intermediate follower or link and without camming thereof. Lever arm 46 applies substantially only axial force to inner control shaft 20. Inner control shaft 20 extends axially beyond drive gear means 8, as shown by the righthand extension 48 beyond driven gear 14. Second lever arm 46 loosely engages inner control shaft 20 at section 48 axially spaced from drive gear means 8, including driven gear 14.

Member 40 is a bell crank pivoted at point 42 above propeller shaft 6 and axially spaced from drive gear means 8, including driven gear 14. Stalk 32 is a rod extending generally vertically upwardly from the lower gear case and having the noted upper end 36 movable up and down by the operator. The lower end 50 of the stalk engages bell crank 40 at a point 52 above propeller shaft 6 and axially spaced from drive gear means 8, including driven gear 14. First lever arm 44 of the bell crank is a clevis coupled to stalk lower end 50. Second lever arm 46 is a fork with spaced tines 54 and 56 loosely engaging inner control shaft 20 at section 48 therebetween. Section 48 of inner control shaft 20 spins between tines 54 and 56 when propeller shaft 6 is driven.

Section 48 of inner control shaft 20 extending axially beyond drive gear means 8 is a spool-like portion loosely engaged by and between tines 54 and 56 of linkage means 38. Spool-like portion 48 has a central section 58 between larger diametered end sections 60 and 62 providing stops engaged by tines 54 and 56 to apply the noted axial force bidirectionally. Inner control shaft 20 is axially slideable within propeller shaft 6 in lost motion relation relative to clutch 18, with resilient means 28 and 30 therebetween. Lever arm 46 engages spool-like portion 48 of inner control shaft 20 in axial lost motion relation between larger diametered end sections 60 and 62.

The direction of up-down translational movement of stalk 32 is orthogonal to the axis of propeller shaft 6.

Pivot axis 42 for bell crank 40 is orthogonal to the axis of propeller shaft 6 and orthogonal to the direction of up-down translational movement of stalk 32. The forward ball bearings of said Croisant et al. patent are replaced by tapered roller bearings 64 for carrying forward thrust, as in Croisant U.S. Pat. No. 3,931,783, incorporated herein by reference.

Stalk 32 and linkage 38 are part of a preassembled subassembly 66 inserted downwardly into a vertical bore 68 in the gear case for receiving the subassembly and accurately locating linkage 38 relative to inner control shaft 20. Subassembly 66 includes a frame 70 having upper shoulders 72 stopped against seats 74 on the gear case to limit insertion and provide accurate vertical location. The frame has walls 76 extending downwardly along and contiguous to bore 68 to provide accurate horizontal location longitudinally and laterally, to thus afford accurate location in all three planes. Pivoted member 40 is mounted at pivot point 42 on subassembly 66.

I claim:

1. Drive engaging linkage for a marine drive lower gear case, comprising:

a propeller shaft rotatably mounted in said lower gear case;

drive gear means in said lower gear case for driving said propeller shaft;

clutch means axially slideable along said propeller shaft to engage said drive gear means for driving said propeller shaft;

inner axial control shaft means axially slideable within said propeller shaft and coupled to said clutch means for axially moving the latter into engagement with said drive gear means;

a pre-assembled subassembly inserted downwardly into said gear case, and including:

operator controlled stalk means extending into said lower gear case and translationally movable therein; and linkage means in said lower gear case operatively connected between said stalk means and said inner axial control shaft means for converting the translational movement of said stalk means into axial movement of said inner control shaft means and said clutch means, wherein said gear case has a vertical bore for receiving said subassembly locating said linkage means relative to said inner control shaft, wherein said linkage means comprises a pivoted member mounted in said lower gear case at a pivot point on said subassembly and having a first lever arm operatively coupled to said stalk means and a second lever arm operatively coupled to said inner control shaft means, such that translational movement of said stalk means in said lower gear case moves said first lever arm which pivots said pivot member which moves said second lever arm which moves said inner control means shaft axially which moves said clutch axially along said propeller shaft, said subassembly, including said stalk means and said pivoted member, being inserted as a single unit into an assembled said gear case.

2. The invention according to claim 1 wherein said second lever arm axially moves said inner control shaft means without camming thereof and applies substantially only axial force thereto.

3. The invention according to claim 1 wherein said inner control shaft means extends axially beyond said drive gear means.

4. The invention according to claim 3 wherein said second lever arm loosely engages said inner control shaft means at a portion axially spaced from said drive gear means.

5. The invention according to claim 4 wherein said pivoted member comprises a crank pivoted at a point above said propeller shaft.

6. The invention according to claim 5 wherein said pivot point is axially spaced from said drive gear means.

7. The invention according to claim 6 wherein said stalk means engages said crank at a point above said propeller shaft and axially spaced from said drive gear means.

8. The invention according to claim 6 wherein said stalk means comprises a rod extending generally vertically upwardly from said lower gear case and having an upper end movable up and down by the operator, and having a lower end engaging said crank at a point above said propeller shaft and axially spaced from said drive gear means.

9. The invention according to claim 8 wherein said crank includes said first lever arm comprising a clevis coupled to said stalk means, and includes said second lever arm comprising a fork with spaced tines loosely engaging said inner control shaft means therebetween, said inner control shaft means spinning between said tines when said propeller shaft is driven.

10. Drive engaging linkage for a marine drive lower gear case, comprising:

a propeller shaft rotatably mounted in said lower gear case;

drive gear means in said lower gear case for driving said propeller shaft;

clutch means axially slideable along said propeller shaft to engage said drive gear means for driving said propeller shaft;

an inner axial control shaft axially slideable within said propeller shaft and coupled to said clutch means for axially moving the latter into engagement with said drive gear means;

a pre-assembled subassembly inserted downwardly into said gear case, and including:

operator controlled stalk means extending into said lower gear case and translationally movable therein; and linkage means comprising a pivoted member mounted in said lower gear case at a pivot point on said subassembly and having a first lever arm operatively coupled to said stalk means and a second lever arm directly engaging said inner control shaft without an intermediate link, such that translational movement of said stalk means in said lower gear case moves said first lever arm which pivots said pivot member which moves said second lever arm which moves said inner control shaft axially which moves said clutch axially along said propeller shaft, said subassembly, including said stalk means and said pivoted member, being inserted as a single unit into an assembled said gear case.

11. The invention according to claim 10 wherein said inner control shaft extends axially beyond said drive gear means and is directly engaged by said second lever arm at a portion axially spaced from said drive gear means.

12. Drive engaging linkage for a marine drive lower gear case, comprising:

a propeller shaft rotatably mounted in said lower gear case;

drive gear means in said lower gear case for driving said propeller shaft;

clutch means axially slideable along said propeller shaft to engage said drive gear means for driving said propeller shaft;

an inner axial control shaft axially slideable within said propeller shaft and coupled to said clutch means for axially moving the latter into engagement with said drive gear means;

a pre-assembled subassembly inserted downwardly into said gear case, and including:

a stalk extending downwardly into said gear case and having an operator controlled upper portion movable up and down; and linkage means in said lower gear case operatively connected between the lower portion of said stalk and said inner control shaft for converting translational up-down movement of said stalk into axial movement of said inner control shaft and said clutch means, wherein:

the direction of said up-down translational movement of said stalk is orthogonal to the axis of said propeller shaft;

said linkage means comprises a crank pivoted about an axis orthogonal to the axis of said propeller shaft and orthogonal to the direction of said up-down translational movement of said stalk;

said crank is mounted in said lower gear case at a pivot point on said subassembly above said propeller shaft and axially spaced from said drive gear means and has a first lever arm operatively coupled to said stalk and a second lever arm operatively coupled to said inner control shaft, such that up-down translational movement of said stalk moves said first lever arm which pivots said crank which moves said second lever arm which moves said inner control shaft axially which moves said clutch means axially along said propeller shaft, said subassembly, including said stalk and said crank, being inserted as a single unit into an assembled said gear case.

13. The invention according to claim 12 wherein:

said inner control shaft extends axially beyond said drive gear means;

said crank second lever arm comprises a fork with spaced tines loosely engaging said inner control shaft therebetween at a portion axially spaced from said drive gear means, said inner control shaft spinning between said tines when said propeller shaft is driven.

14. Drive engaging linkage for a marine drive lower gear case, comprising:

a propeller shaft rotatably mounted in said lower gear case;

drive gear means in said lower gear case for driving said propeller shaft;

clutch means axially slideable along said propeller shaft to engage said drive gear means for driving said propeller shaft;

a pre-assembled subassembly inserted into said gear case, and including:

operator controlled stalk means extending into said lower gear case and movable therein; and linkage means comprising a pivoted member monted in said lower gear case at a pivot point on said subassembly and operatively coupled between said stalk means and said clutch means such that movement of said stalk means pivots said pivot member which moves said clutch means, said subassembly, including said stalk means and said pivoted member, being inserted as a single unit into an assembled said gear case.

* * * * *